US012698954B2

(12) United States Patent
Guyon

(10) Patent No.: US 12,698,954 B2
(45) Date of Patent: Aug. 4, 2026

(54) SINGLE-CAPACITOR ELECTRONIC DETONATOR AND SYSTEM FOR FIRING SUCH SINGLE-CAPACITOR ELECTRONIC DETONATORS

(71) Applicant: DAVEY BICKFORD, Hery (FR)

(72) Inventor: Franck Guyon, Auxerre (FR)

(73) Assignee: DAVEY BICKFORD, Hery (FR)

( * ) Notice: Subject to any disclaimer, the term of this patent is extended or adjusted under 35 U.S.C. 154(b) by 0 days.

(21) Appl. No.: 18/840,466

(22) PCT Filed: Mar. 9, 2023

(86) PCT No.: PCT/FR2023/050322

§ 371 (c)(1),
(2) Date: Aug. 21, 2024

(87) PCT Pub. No.: WO2023/170369

PCT Pub. Date: Sep. 14, 2023

(65) Prior Publication Data

US 2025/0207899 A1 Jun. 26, 2025

(30) Foreign Application Priority Data

Mar. 11, 2022 (FR) ..... 2202147

(51) Int. Cl.
*F42C 19/12* (2006.01)
*F42D 1/055* (2006.01)

(52) U.S. Cl.
CPC ..... *F42C 19/12* (2013.01); *F42D 1/055* (2013.01)

(58) Field of Classification Search
CPC ..... F42B 3/182; F42C 11/008; F42C 11/06; F42C 11/065; F42C 15/40; F42D 1/04; F42D 1/045; F42D 1/05; F42D 1/055
(Continued)

(56) References Cited

U.S. PATENT DOCUMENTS 3,741,124 A 6/1973 Visk
4,536,693 A 8/1985 Marek
(Continued)

FOREIGN PATENT DOCUMENTS

EP 0992760 A1 4/2000
FR 2300322 A1 9/1976
FR 2672675 A1 8/1992

OTHER PUBLICATIONS

Office Action, issued in Taiwanese Patent Application No. 112108285 dated May 16, 2024.

(Continued)

*Primary Examiner* — Troy Chambers
*Assistant Examiner* — Benjamin S Gomberg
(74) *Attorney, Agent, or Firm* — NIXON & VANDERHYE

(57) ABSTRACT

The invention relates to a single-capacitor electronic detonator (10) comprising an explosive-initiating means (11), electronic control means (16) and a single energy storage capacitor (15) for supplying the electronic control means (16) and the explosive-initiating means (11) with power when firing the single-capacitor electronic detonator (10). It further comprises means (18) for clipping the voltage across the terminals of the single energy storage capacitor (14) to a value lower than a non-firing voltage value (Ua) of the explosive-initiating means (11), and voltage-regulating means (19) connected to means (13) for connecting to a power source (12), which means are suitable for limiting the output voltage to a value lower than a non-firing voltage value (Ua) of the explosive-initiating means (11). The invention also relates to the use thereof in a firing system to improve safety when using single-capacitor electronic detonators (10).

10 Claims, 1 Drawing Sheet

(58) Field of Classification Search
USPC ..... 102/206
See application file for complete search history.

(56) References Cited

U.S. PATENT DOCUMENTS 4,586,437 A * 5/1986 Miki ..... F42C 11/06 102/206
4,825,765 A * 5/1989 Ochi ..... F42D 1/055 102/206
4,829,899 A * 5/1989 Wiker ..... F42C 11/065 102/206
5,189,246 A * 2/1993 Marsh ..... F42D 1/055 102/202.1
5,367,957 A * 11/1994 Hennessey ..... F42D 1/055 361/249
5,460,093 A 10/1995 Prinz et al.
5,520,114 A 5/1996 Guimard
5,602,713 A * 2/1997 Kurogi ..... F42C 11/06 361/249
5,912,428 A * 6/1999 Patti ..... F42B 3/122 307/141.8
6,173,651 B1 * 1/2001 Pathe ..... F42B 3/122 102/206
2003/0029344 A1 * 2/2003 Eddy ..... F42D 1/05 102/200
2012/0291650 A1 * 11/2012 Aw ..... F42C 11/00 102/207
2018/0321024 A1 * 11/2018 Guyon ..... F42B 3/121
2019/0063891 A1 * 2/2019 Rastegar ..... H02N 2/181
2020/0278187 A1 * 9/2020 Biard ..... F42D 5/00

OTHER PUBLICATIONS

International Search Report for PCT/FR2023/050322, mailed Jun. 5, 2023, 6 pages.
Written Opinion of the ISA for PCT/FR2023/050322, mailed Jun. 5, 2023, 6 pages.

* cited by examiner

SINGLE-CAPACITOR ELECTRONIC DETONATOR AND SYSTEM FOR FIRING SUCH SINGLE-CAPACITOR ELECTRONIC DETONATORS

This application is the U.S. national phase of International Application No. PCT/FR2023/050322 filed Mar. 9, 2023, which designated the U.S. and claims priority to FR Patent Application No. 2202147 filed Mar. 11, 2022, the entire contents of each of which are hereby incorporated by reference.

BACKGROUND OF THE INVENTION

1. Field of the Invention

The present invention relates to a single-capacitor electronic detonator and a system for firing such single-capacitor electronic detonators.

The present invention generally applies to the field of mines and quarries and public works sites using programmable electronic detonators fired remotely according to a predetermined firing plan.

2. Description of Related Art

The electronic detonators are used to initiate an explosive. An electronic detonator thus comprises an explosive-initiating means, formed for example by a fusehead, connected to electronic control means. The electronic detonator also comprises means for connection to an external energy source to supply the electronic detonator with energy.

The main function of the electronic control means is to delay firing. In this way, a countdown is implemented when the electronic detonator receives a firing command, the firing of the explosive-initiating means being triggered at the end of the countdown. The electronic control means must be able to operate autonomously, without supplying energy to the electronic detonator, once the firing command has been received.

To this end, an electronic detonator has one or two energy storage capacitors.

In the embodiments in which the electronic detonator comprises two energy storage capacitors, a first energy storage capacitor is designed to store the energy required to supply the electronic control means, in particular for implementing the delay countdown, and a second capacitor is designed to store the energy required to fire the explosive-initiating means.

In the embodiments in which the electronic detonator comprises a single energy storage capacitor, the latter is designed, firstly, to supply the electronic control means with energy and, secondly, to supply the explosive-initiating means when the electronic detonator is fired.

The lower cost of an electronic detonator with a single capacitor (hereinafter a single-capacitor electronic detonator) is a clear advantage.

However, electronic detonators with two energy storage capacitors are safer for operators than single-capacitor electronic detonators.

Indeed, in principle, an electronic detonator with two capacitors allows the first energy storage capacitor dedicated to supplying the electronic control means to be charged when the electronic detonator is connected to an external energy source, for example through conductive wires.

The second energy storage capacitor dedicated to firing the explosive-initiating means is only charged with energy when a charging command is received, before a firing command is sent and received.

The electronic detonator with two capacitors therefore operates safely, preventing accidental firing of the explosive-initiating means before the initiation of a blast.

In a single-capacitor electronic detonator, the single energy storage capacitor is charged once the electronic detonator is connected to an external energy source by connection means.

The energy or some of the energy required to supply the explosive-initiating means when the single-capacitor electronic detonator is fired is therefore stored in the single-capacitor electronic detonator once it is connected to an external energy source.

If a blasting switch located between the explosive-initiating means and the energy storage capacitor is accidentally closed, accidental firing may occur.

In order to ensure a reliable level of safety for operators when handling single-capacitor electronic detonators, these are operated by equipment (programming console, firing console) which are designed to limit the electrical voltage that can be supplied on the connection lines of the single-capacitor electronic detonators.

In this way, the external energy source always has an electrical voltage lower than a non-firing voltage value of the explosive-initiating means integrated into each single-capacitor electronic detonator.

The non-firing voltage corresponds to a voltage value below which it is impossible to fire the explosive-initiating means.

By selecting a non-firing voltage value of the explosive-initiating means, it is ensured that the electrical voltage of the external energy source is always sufficiently lower than the firing voltage, known as the all-fire voltage.

The all-fire voltage corresponds to the voltage above which the explosive-initiating means is systematically fired.

Such a single-capacitor electronic detonator has a very high level of safety when it is operated with the dedicated equipment.

However, this level of safety can deteriorate and be lower than that provided by an electronic detonator with two capacitors if the single-capacitor electronic detonator is connected to an electrical voltage source and equipment other than that supplied and recommended by the firing system.

SUMMARY

The object of the present invention is to overcome at least one of the aforementioned drawbacks and propose a single-capacitor electronic detonator with an improved level of safety.

According to a first aspect, the present invention relates to a single-capacitor electronic detonator, comprising an explosive-initiating means, electronic control means, a single energy storage capacitor designed to supply said electronic control means and said explosive-initiating means with energy when said single-capacitor electronic detonator is fired, and means for connection to an energy source for supplying said single energy storage capacitor with energy.

According to the invention, the single-capacitor electronic detonator also has means for clipping the voltage applied to the terminals of said single energy storage capacitor, said clipping means having a threshold clipping value lower than a non-firing voltage value of said explosive-initiating means, said clipping being means controlled by said electronic control means between an activated position, in which said clipping means limit said voltage to a value lower than said threshold clipping value, and a deactivated position, in which said clipping means are inactive.

In this way, the voltage at the terminals of the single energy storage capacitor can be limited by default at the electronic detonator itself: whatever the voltage applied to the connection means of the electronic detonator, the voltage at the terminals of the energy storage capacitor remains lower than the non-firing voltage value of the explosive-initiating means of the electronic detonator.

Non-accidental firing of the electronic detonator is provided by the design of the single-capacitor electronic detonator itself, and is not dependent on the equipment to which it is connected during use.

According to a second aspect, the present invention also relates to a single-capacitor electronic detonator, comprising an explosive-initiating means, electronic control means, a single energy storage capacitor designed to supply said electronic control means and said explosive-initiating means with energy when said single-capacitor electronic detonator is fired, and means for connection to an energy source for supplying said single energy storage capacitor with energy.

According to the invention, the single-capacitor electronic detonator also comprises voltage regulation means connected to said means for connection to an energy source, said voltage regulation means being controlled by said electronic control means between at least one high-voltage position, in which the output voltage of the voltage regulation means is greater than a non-firing voltage value of said explosive-initiating means, and a low-voltage position, in which the output voltage of the voltage regulation means is lower than said non-firing voltage value of said explosive-initiating means.

In this way, the voltage at the terminals of the single energy storage capacitor can be limited by default at the electronic detonator itself: whatever the voltage applied to the connection means of the electronic detonator, the voltage at the terminals of the energy storage capacitor remains lower than the non-firing voltage value of the explosive-initiating means of the electronic detonator.

Non-accidental firing of the electronic detonator is provided by the design of the single-capacitor electronic detonator itself, and is not dependent on the equipment to which it is connected during use.

DETAILED DESCRIPTION

According to one embodiment of the invention, the single-capacitor electronic detonator comprises voltage regulation means as described above connected between the means for connection to an energy source and clipping means as described above.

The combination of the voltage regulation means and clipping means further enhances the safety of the single-capacitor electronic detonator, by virtue of its very design.

According to an alternative embodiment of the invention, the clipping means are connected between the means for connection to an energy source and said voltage regulation means.

In one practical embodiment, said electronic control means are designed to control both said clipping means in said activated position and said voltage regulation means in said low-voltage position.

The two protection means, clipping means and voltage regulation means are thus active at the same time.

Advantageously, when the electronic control means are powered up, said electronic control means are designed to control said clipping means in said activated position and/or said voltage regulation means in said low-voltage position.

Whatever the voltage applied to the bus line or supply line to which the single-capacitor electronic detonator is connected, the voltage at the terminals of the energy storage capacitor is lower than the non-firing voltage value of said explosive-initiating means.

In practice, and in order to further improve the operational safety of the single-capacitor electronic detonator, when said electronic control means detect an interruption in the power supply to said single-capacitor electronic detonator for a predefined period, said electronic control means are designed to control said clipping means in said activated position and/or said voltage regulation means in said low-voltage position.

According to one embodiment, when said electronic control means receive a dedicated command before said single-capacitor electronic detonator is fired, said electronic control means are designed to control said clipping means in said deactivated position and/or said voltage regulation means in said high-voltage position.

Upon receiving a dedicated command before firing, the energy storage capacitor can be charged by an energy source to an adequate voltage to then enable the explosive-initiating means to be fired.

In practice, the dedicated command can be a command for charging the energy storage capacitor.

Alternatively, the dedicated command can be a command for deactivating the protection means, i.e. the clipping means and the voltage regulation means, a command for charging the energy storage capacitor being received later by the single-capacitor electronic detonator.

The electronic control means can deactivate the two protection means, i.e. the clipping means and the voltage regulation means, when the single-capacitor electronic detonator receives a single dedicated command before firing or a firing command.

Alternatively, the electronic control means can deactivate only one of the two protection means, i.e. the clipping means or the voltage regulation means, when the single-capacitor electronic detonator receives a dedicated command before firing.

The dedicated command can be a command for charging the energy storage capacitor or a specific command for deactivating one of the two protection means.

In practice, the electronic control means can deactivate a first protection means, for example the clipping means, upon receipt of a first deactivation command, then a second protection means, for example the voltage regulation means, upon receipt of a second deactivation command. Of course, the order in which the two protection means are deactivated can be reversed.

Deactivation of the two protection means then requires that the single-capacitor electronic detonator receives two dedicated commands in succession before firing.

According to a third aspect, the invention also relates to a system for firing one or more single-capacitor electronic detonators according to the invention.

The firing system comprises a firing console designed to transmit, to said electronic control means of one or more single-capacitor electronic detonators, a command to switch said clipping means from said activated position to said deactivated position and/or a command to switch said voltage regulation means from said low-voltage position to said high-voltage position.

Said firing console is advantageously designed to transmit separately said command to switch said clipping means from said activated position to said deactivated position and said command to switch said voltage regulation means from said low-voltage position to said high-voltage position.

This separate control of the clipping means and voltage regulation means enhances the level of safety in the event of failure of one or other of the two switching commands.

Said electronic control means are advantageously designed, upon receiving a first command to switch said clipping means from said activated position to said deactivated position, or said voltage regulation means from said low-voltage position to said high-voltage position, to cancel said first switching command if, within a predetermined time period, a second command to switch said voltage regulation means from said low-voltage position to said high-voltage position, or said clipping means from said activated position to said deactivated position, is not received.

BRIEF DESCRIPTION OF THE DRAWINGS

Other features and advantages of the invention will become apparent in the description below.

In the appended drawings, provided by way of non-limiting example.

DETAILED DESCRIPTION OF PREFERRED EMBODIMENTS

Figure 1:
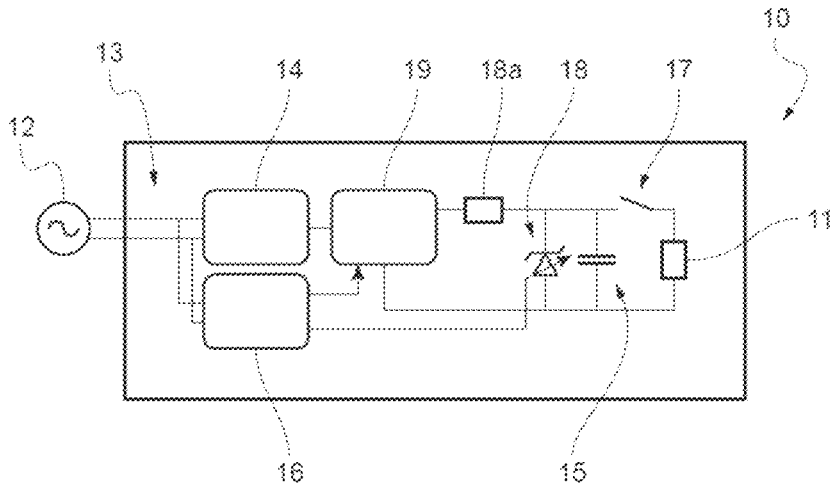
FIG. 1 shows a block diagram of a single-capacitor electronic detonator according to one embodiment of the invention.

With reference to FIG. 1, a single-capacitor electronic detonator according to one embodiment of the invention will first of all be described.

Conventionally, an electronic detonator is used in mines, quarries and public works to initiate the explosive.

Typically, such an electronic detonator can be used in a firing plan with numerous other electronic detonators. As a general principle, an electronic detonator comprises an explosive-initiating means, hereinafter referred to in a non-limiting manner as fusehead, connected to an electronic control circuit. The electronic control circuit of each electronic detonator includes a firing delay function, triggering the firing of each electronic detonator after a pre-programmed delay countdown. This function of electronic detonators is known and does not need to be described in detail in the present description.

As shown schematically in FIG. 1, a single-capacitor electronic detonator 10 comprises a fusehead 11 connected to an electronic control circuit supplied with electric current.

The single-capacitor electronic detonator 10 comprises means 13 for connection to an energy source 12 to supply the electronic control circuit with energy. The connection means 13 comprise, for example, conductive wires and a connection box (not shown) enabling the single-capacitor electronic detonator 10 to be connected to the energy source 12, via a power supply line, for instance.

The energy source 12 can be formed by an electric battery, for example.

At the input of the electronic control circuit, the single-capacitor electronic detonator 10 comprises means for filtering and rectifying the current 14. These means for filtering and rectifying the current 14 are common and enable the electronic control circuit of the single-capacitor electronic detonator 10 to be supplied with direct current.

In this way, the electronic control circuit can be supplied with direct current via the conductive wires of the means 13 for connection to an energy source 12, consisting of an external alternating current supply.

However, the electronic control circuit has to be able to operate autonomously, without any electrical energy being supplied by the means 13 for connection to the energy source 12, in particular when a firing command is received by the single-capacitor electronic detonator 10.

To this end, energy storage means are provided in the single-capacitor electronic detonator 10.

As shown in FIG. 1, a single energy storage capacitor 15 is provided in the single-capacitor electronic detonator 10. This energy storage capacitor 15 is designed to supply the electronic control circuit, and in particular electronic control means 16, and the fusehead 11 with energy when the single-capacitor electronic detonator 10 is fired.

In this way, the energy storage capacitor 15 provides an autonomous power supply, firstly to the electronic control means 16 during the delay countdown associated with the single-capacitor electronic detonator 10, and secondly to the fusehead 11 for firing.

As soon as the single-capacitor electronic detonator 10 is electrically connected to the energy source 12, the energy storage capacitor 15 is charged.

In this way, the energy, or at least some of the energy depending on the amplitude of the voltage applied to the conductive wires of the connection means 13, required to fire the fusehead 11 is charged and stored in the energy storage capacitor 15 of the single-capacitor electronic detonator 10.

The single-capacitor electronic detonator 10 also comprises a blasting switch 17 mounted between the energy storage capacitor 15 and the fusehead 11. Conventionally, when a firing command from a firing console is received by the single-capacitor electronic detonator 10, the electronic control means 16 control the closure of the blasting switch 17, thus initiating the firing of the fusehead 11 powered by the energy storage capacitor 15.

However, in order to ensure safe use, the single-capacitor electronic detonator 10 has protection means in order to prevent the energy storage capacitor 15 from being charged with enough electrical energy to fire the fusehead 11 until such time as a specific firing command has been sent and received by the single-capacitor electronic detonator 10.

In the exemplary embodiment shown in FIG. 1, the protection means comprise both means 18 for clipping the voltage across the terminals of the energy storage capacitor 15 and voltage regulation means 19 connected to the means 13 for connection to the energy source 12.

The clipping means 18 have a threshold clipping value Us lower than a non-firing voltage value Ua of the fusehead 11.

The clipping means 18 are controlled by the electronic control means 16 between an activated position, in which the clipping means 18 limit the voltage to a value lower than the threshold clipping value Us, and a deactivated position, in which the clipping means 18 are inactive.

In the embodiment shown in FIG. 1, the clipping means 18 are connected in parallel with the energy storage capacitor 15. When the clipping means 18 are activated, the charging voltage of the energy storage capacitor 15 remains lower than the threshold clipping value Us, and therefore than the non-firing voltage Ua of the fusehead 11.

If the blasting switch 17 is accidentally closed, the charging voltage of the energy storage capacitor 15 is not enough to cause the fusehead 11 to be fired.

The clipping means 18 can consist, in a manner known to a person skilled in the art, of one or more diodes, and, for example, a Zener diode.

The voltage regulation means 19 are controlled by the electronic control means 16 between a high-voltage position, in which the output voltage of the voltage regulation means 19 is greater than the non-firing voltage value Ua of the fusehead 11, and a low-voltage position, in which the output voltage of the voltage regulation means 19 is lower than the non-firing voltage value Ua of the fusehead 11.

In the embodiment shown in FIG. 1, the voltage regulation means 19 are connected in series with the energy storage capacitor 15. When the voltage regulation means 19 are in a low-voltage position, the charging voltage of the energy storage capacitor 15 remains lower than the non-firing voltage value Ua of the fusehead 11.

If the blasting switch 17 is accidentally closed, the charging voltage of the energy storage capacitor 15 is not enough to cause the fusehead 11 to be fired.

The voltage regulation means 19 can consist, in a manner known to a person skilled in the art, of a circuit of one or more diodes and transistors.

In the embodiment shown in FIG. 1, the voltage regulation means 19 are connected between the means 13 for connection to the energy source 12 and the clipping means 18.

A resistor 18*a* is advantageously connected in series between the voltage regulation means 19 and the clipping means 18 in order to limit the current in the circuit of the clipping means 18 when the voltage regulation means 19 are in a high-voltage position.

The voltage regulation means 19 are designed, in a high-voltage position, either to supply the current at a voltage equal to the supply voltage of the single-capacitor electronic detonator 10, or at a regulated voltage, with a value greater than the all-fire voltage value of the fusehead 11 of the single-capacitor electronic detonator 10.

The single-capacitor electronic detonator 10 thus has dual protection, with the aim of preventing any accidental charging of the energy storage capacitor 15 to a voltage that is enough to fire the fusehead.

The non-firing voltage Ua corresponds to the voltage below which it is impossible to fire the explosive-initiating means.

Conversely, the all-fire voltage corresponds to a voltage value above which the explosive-initiating means is systematically fired.

Firing is probable between these two voltage values.

Determining the non-firing voltage and the all-fire voltage depends on the technology of the filaments used, the pyrotechnic compositions, the substrates and the interfaces between the various components that make up the fusehead. The values of these voltages can be determined by statistical test methods during the development and prototype phase of the single-capacitor electronic detonators, such as the PROBIT statistical method or BRUCETON test method.

By way of non-limiting example, the non-firing voltage value Ua is comprised between 6 and 10 volts, and is for example equal to 8 volts.

The all-fire voltage value of the fusehead 11 is comprised between 15 and 17 volts, by way of non-limiting example.

In order to ensure this dual protection, the electronic control means 16 are designed to both control the clipping means 18 in the activated position and the voltage regulation means 19 in the low-voltage position.

As will be described in more detail below, the control of the clipping means 18 in the activated position and the control of the voltage regulation means 19 in the low-voltage position are preferably simultaneous. They can also be sent one after the other to the single-capacitor electronic detonator 10.

Of course, it is possible for the single-capacitor electronic detonator 10 to only have a single protection means, and for example just clipping means 18 or just voltage regulation means 19.

When the single-capacitor electronic detonator 10 is connected to the energy source 12, i.e. when the electronic control means 16 are powered up, the electronic control means 16 are designed to control the clipping means 18 in the activated position and/or the voltage regulation means 19 in the low-voltage position.

Preferably, when the single-capacitor electronic detonator 10 is powered up, the clipping means 18 are controlled in the activated position and the voltage regulation means 19 are controlled in the low-voltage position.

Similarly, when the electronic control means 16 detect an interruption in the power supply to the single-capacitor electronic detonator 10 for a predefined period, the electronic control means 16 are designed to control the clipping means 18 in the activated position and/or the voltage regulation means 19 in the low-voltage position.

Thus, in the event of a loss of voltage on the supply line of the single-capacitor electronic detonator 10 for a predefined period, for example a few milliseconds, the configuration of the single-capacitor electronic detonator 10 is reinitialised at the protection means, whatever the state of progress of the programming of the single-capacitor electronic detonator 10 in the firing configuration.

Preferably, in the event of loss of power to the single-capacitor electronic detonator 10, the clipping means 18 are controlled in the activated position and the voltage regulation means 19 are controlled in the low-voltage position.

During the firing configuration, the electronic control means 16 receive one or more dedicated commands before the single-capacitor electronic detonator 10 is fired.

Upon receipt of one or more dedicated commands, the electronic control means 16 are designed to control the clipping means 18 in the deactivated position and/or the voltage regulation means 19 in the high-voltage position.

The single-capacitor electronic detonator 10 can thus be controlled in order to enable charging of the energy storage capacitor 15 to a voltage that is enough to enable the fusehead 11 to be fired.

Figure 2:
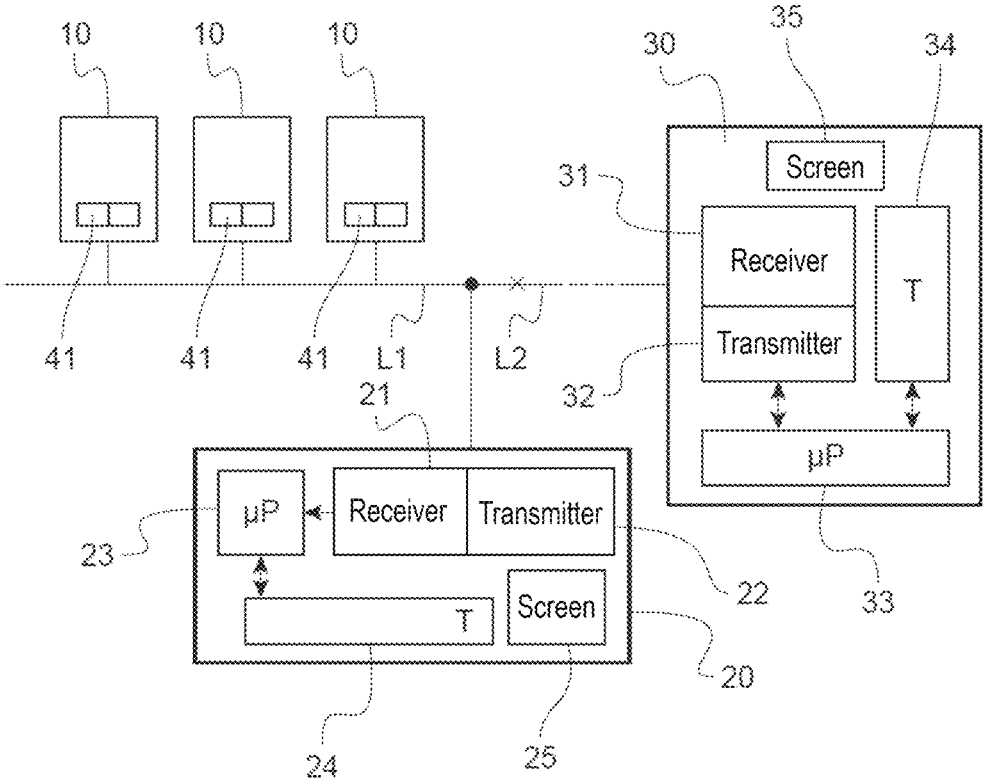
FIG. 2 shows a block diagram of a firing system according to one embodiment of the invention.

With reference to FIG. 2, an exemplary embodiment will be described in more detail in a system for firing one or more single-capacitor electronic detonators 10 as described above.

The single-capacitor electronic detonators 10 are each designed to be installed in a blast hole at the face.

Typically, each single-capacitor electronic detonator 10 is placed with a predetermined quantity of explosive into a blast hole drilled into a wall.

All of the single-capacitor electronic detonators 10 installed in this way at the front are then intended to be fired in a single blast.

In this embodiment, the firing system comprises a mobile test device 20 designed to be connected to a bus line L1.

The single-capacitor electronic detonators 10 are also connected to the bus line L1 and thus connected to the mobile test device 20.

The mobile test device 20 can thus communicate with one or more single-capacitor electronic detonators 10, either simultaneously or individually, in order to read information or data stored by the single-capacitor electronic detonators 10, send information or commands to these single-capacitor electronic detonators 10 and test their connection and their operating state.

In some embodiments, the mobile test device 20 is also designed to programme the electronic detonators 10, and for example to programme a firing delay.

The mobile test device 20 conventionally comprises receiving 21 and sending means 22 enabling it to communicate with the electronic detonators 10, either simultaneously or individually.

The receiving 21 and sending means 22 can consist of a bidirectional transmitter/receiver known to a person skilled in the art in the field of wired network communication.

Although in the exemplary embodiment shown in FIG. 2 the single-capacitor electronic detonators 10 and the mobile test device 20 are connected by a wired connection by means of the bus line L1, the invention is not limited to this type of connection.

In particular, the mobile test device 20 and the single-capacitor electronic detonators 10 could communicate via a wireless connection, in particular via radio link. The receiving 21 and sending means 22 can therefore consist of a bidirectional transmitting/receiving antenna known to a person skilled in the art in the field of wireless network communication.

The mobile test device 20 also comprises a microprocessor 23 for carrying out various data processing, calculations and settings useful for installing single-capacitor electronic detonators 10 at the face.

The mobile test device 20 also comprises an EEPROM writable memory 24 ("Electrically Erasable Programmable Read Only Memory") and display means consisting of a screen 25 to communicate with the user.

The firing system further comprises a firing console 30, forming a remote firing device, designed to communicate and transmit commands to electronic control means 16 of the single-capacitor electronic detonators.

The firing console 30 is designed to be remotely connected to the single-capacitor electronic detonators 10.

As shown in FIG. 2, the firing console 30 is connected via a firing line L2, itself connected to the bus line L1.

The firing console 30 is designed to be placed far away from the face in order to enable the operator controlling the firing from the firing console 30 to initiate firing in complete safety.

The firing console 30 comprises receiving 31 and sending means 32 enabling bidirectional communication between the single-capacitor electronic detonators 10 and the firing console 30, either simultaneously or individually.

The receiving 31 and sending means 32 are similar to those described above in relation to the mobile test device 20.

The firing console 30 also comprises a microprocessor 33 for carrying out various data processing, calculations and settings required for firing.

An EEPROM programmable memory 34 is also provided in the firing console 30.

A display screen 35 can also be fitted to the firing console 30 in order to communicate with the operator.

Each single-capacitor electronic detonator 10 comprises bidirectional communication means 41 designed to enable communication between the single-capacitor electronic detonator 10 and the mobile test device 20 and/or the firing console 30. The bidirectional communication means 41 of the single-capacitor electronic detonators 10 are similar to the receiving 21 and sending means 22 described above in relation to the mobile test device 20 or to the receiving 31 and sending means 32 of the firing console 30.

The role and operation of the mobile test device 20 and the firing console 30 are known in their general principles for programming firing, the delay time associated with each single-capacitor electronic detonator 10 and the actual firing, with only the particularities of communication between the firing console 30 and the single-capacitor electronic detonators 10 being described in detail below.

The firing console 30 is designed to send to each single-capacitor electronic detonator 10 connected to the firing line L2 a command to switch the clipping means 18 from the activated position to the deactivated position and/or a command to switch the voltage regulation means 19 from the low-voltage position to the high-voltage position.

In this way, the protection means of each single-capacitor electronic detonator 10 can be remotely controlled by the firing console 30.

In preparation for firing, and therefore for charging the energy storage capacitor 15 of each single-capacitor electronic detonator 10 with enough energy to fire the fusehead 11, the firing console 30 makes it possible to send dedicated commands to the single-capacitor electronic detonators 10 to switch the clipping means 18 and the voltage regulation means 19 into a power supply mode at a voltage known as the full-fire voltage of the fusehead 11.

The firing console 30 is preferably designed to transmit separately the command to switch the clipping means 18 from the activated position to the deactivated position and the command to switch the voltage regulation means 19 from the low-voltage position to the high-voltage position.

Two separate dedicated commands are thus sent to each single-capacitor electronic detonator 10 to control the transition from a low-voltage level to a high-voltage level of the power supply to the single-capacitor electronic detonator 10. This dual control thus makes it possible to enhance the safe use of the single-capacitor electronic detonators 10.

In such a configuration, the electronic control means 16 of each single-capacitor electronic detonator 10 are designed, after having received a first command to switch the clipping means 18 from the activated position to the deactivated position, to cancel this first switching command if, within a predetermined time period, a second command to switch the voltage regulation means 19 from the low-voltage position to the high-voltage position is not received.

Similarly, the electronic control means 16 of each single-capacitor electronic detonator 10 are designed, after having received a first command to switch the voltage regulation means 19 from the low-voltage position to the high-voltage position, to cancel this first switching command if, within a predetermined time period, a second command to switch the clipping means 18 from the activated position to the deactivated position is not received.

Thus, after the predetermined time period for receiving a second switching command, the single-capacitor electronic detonator 10 is reconfigured in the safety position, the protection means being once again both designed to supply the energy storage capacitor 15 at a voltage level less than the non-firing voltage value of the fusehead 11.

In practice, the firing console 30 may only have a single control key for sending the first switching command and the second switching command to the single-capacitor electronic detonators 10. This dual transmission of switching commands thus improves the safe use of the single-capacitor electronic detonators 10 without increasing the level of complexity involved for the operator of the firing console 30.

Of course, this mode of operation of the firing console 30 is not limiting. The firing console 30 can also be designed to transmit simultaneously, in the same dedicated command, the command to switch the clipping means 18 from the activated position to the deactivated position and the command to switch the voltage regulation means 19 from the low-voltage position to the high-voltage position.

These dedicated switching commands, sent by the firing console 30 to deactivate the protection means of each single-capacitor electronic detonator 10, are only sent by the firing console 30, at the very end of the firing programming procedure, and just before a command is sent to fire all of the single-capacitor electronic detonators 10.

This means that these dedicated switching commands to deactivate the protection means of each single-capacitor electronic detonator 10 cannot be sent by the mobile test device 20.

On the other hand, the mobile test device 20 or the firing console 30 can send a single dedicated command to activate the protection means of each single-capacitor electronic detonator 10, i.e. to control the clipping means 18 in the activated position and the voltage regulation means 19 in the low-voltage position.

Thus, the single-capacitor electronic detonators 10 have voltage protection devices, enabling the operator to be protected when the single-capacitor electronic detonators 10 are connected to the bus line L1 and during the entire programming and test phase of the single-capacitor electronic detonators 10.

In particular, the mobile test device 20 can be used safety at the face, even if the voltage supplied by the mobile test device 20 is greater than the non-firing voltage value of the fusehead 11 of the single-capacitor electronic detonators 10. Indeed, it is sometimes useful for the mobile test device 20 to supply a high voltage in order to address networks of numerous single-capacitor electronic detonators 10 connected simultaneously to the same bus line L1.

Compared to an electronic detonator with two capacitors, such a single-capacitor electronic detonator 10 is thus more economical thanks to the use of a single energy storage capacitor 15, whilst guaranteeing a high level of user safety, which does not depend on the equipment to which it is connected.

Of course, the invention is not limited to the exemplary embodiments described above.

In particular, the clipping means (18) can also be connected between the means (13) for connection to the energy source (12) and the voltage regulation means (19).

The invention claimed is:

1. A single-capacitor electronic detonator, comprising:

an explosive initiator (11), electronic controller (16), a single energy storage capacitor (15) connected to said electronic controller (16) and to said explosive initiator (11), and connection means (13) for connection to an energy source (12) for supplying said single energy storage capacitor (15) with energy, said single energy storage capacitor (15) being designed to supply said electronic controller (16) with energy and said explosive initiator (11) with energy when said single-capacitor electronic detonator (10) is fired, wherein the single-capacitor electronic detonator also comprises a clipper (18) for clipping the voltage across terminals of said single energy storage capacitor (15), said clipping means clipper (18) having a threshold clipping value (Us) lower than a non-firing voltage value (Ua) of said explosive initiator (11), said clipper (18) being controlled by said electronic controller (16) between an activated position, in which said clipper (18) limits said voltage to a value lower than said threshold clipping value (Us), and a deactivated position, in which said clipper (18) is inactive.

2. The single-capacitor electronic detonator in accordance with claim 1, wherein a voltage regulator (19) is connected between the connection means (13) and said clipper (18).

3. The single-capacitor electronic detonator according to claim 2, wherein said electronic controller (16) is designed to control both said clipper (18) in said activated position and a voltage regulator (19) in a low-voltage position.

4. The single-capacitor electronic detonator according to claim 1, wherein when the electronic controller (16) is powered up, said electronic controller (16) is designed to control said clipper (18) in said activated position and/or a voltage regulator (19) in a low-voltage position.

5. The single-capacitor electronic detonator according to claim 1, wherein when said electronic controller (16) detects an interruption in power being supplied to said single energy storage capacitor (15) for a predefined period, said electronic controller (16) is designed to control said clipper (18) in said activated position and/or a voltage regulator (19) in a low-voltage position.

6. The single-capacitor electronic detonator according to claim 1, wherein when said electronic controller (16) receives a dedicated command before said single-capacitor electronic detonator (10) is fired, said electronic controller (16) is designed to control said clipper (18) in said deactivated position and/or a voltage regulator (19) in a high-voltage position.

7. A firing system for a single-capacitor electronic detonator (10) according to claim 1, wherein the firing system comprises:

a firing console (30) designed to transmit, to said electronic controller (16) of the single-capacitor electronic detonator (10), a command to switch said clipper (18) from said activated position to said deactivated position and/or a command to switch a voltage regulator (19) from a low-voltage position to a high-voltage position.

8. The firing system according to claim 7, wherein said firing console (30) is designed to transmit separately said command to switch said clipper (18) from said activated position to said deactivated position and said command to switch said voltage regulator (19) from said low-voltage position to said high-voltage position.

9. The firing system according to claim 8, wherein said electronic controller (16) is designed, upon receiving the command to switch said clipper (18) from said activated position to said deactivated position, or the command to switch said voltage regulator (19) from said low-voltage position to said high-voltage position, to cancel said command to switch said voltage regulator (19) or said command to switch said clipper (18) if, within a predetermined time period, a second command to switch said voltage regulator (19) from said low-voltage position to said high-voltage position, or said clipper (18) from said activated position to said deactivated position, is not received.

10. A single-capacitor electronic detonator, comprising:

an explosive initiator (11), electronic controller (16), a single energy storage capacitor (15) connected to said electronic controller (16) and to said explosive initiator (11), and connection means (13) for connection to an energy source (12) for supplying said single energy storage capacitor (15) with energy, said single energy storage capacitor (15) being designed to supply said electronic controller (16) with energy and said explosive initiator (11) with energy when said single-capacitor electronic detonator (10) is fired, wherein the single-capacitor electronic detonator also comprises a voltage regulator (19) connected to said connection means (13), said voltage regulator (19) being controlled by said electronic controller (16) between at least one high-voltage position, in which an output voltage of the voltage regulator (19) is greater than a non-firing voltage value (Ua) of said explosive initiator (11), and a low-voltage position, in which the output voltage of the voltage regulator (19) is lower than said non-firing voltage value (Ua) of said explosive initiator (11).

* * * * *